US007896450B2

(12) United States Patent
Yamazaki et al.

(10) Patent No.: US 7,896,450 B2
(45) Date of Patent: Mar. 1, 2011

(54) SHOWCASE

(75) Inventors: Shouichi Yamazaki, Maebashi (JP); Nobuo Kanbayashi, Saitama (JP); Hayato Zushida, Kiryu (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 480 days.

(21) Appl. No.: 11/970,572

(22) Filed: Jan. 8, 2008

(65) Prior Publication Data

US 2008/0169735 A1 Jul. 17, 2008

(30) Foreign Application Priority Data

Jan. 11, 2007 (JP) ..... 2007-003575

(51) Int. Cl.
*A47F 3/00* (2006.01)
*A47B 88/00* (2006.01)
*A47G 29/00* (2006.01)

(52) U.S. Cl. ..... 312/114; 312/330.1; 312/265.1

(58) Field of Classification Search ..... 312/114, 312/116, 128–133, 138.1–139.2, 330.1, 402, 312/236, 127, 283, 286, 287, 290, 334.1, 312/334.6, 334.14, 334.27; 219/214, 218, 219/385

See application file for complete search history.

(56) References Cited

U.S. PATENT DOCUMENTS

| | | | | |
|---|---|---|---|---|
| 670,404 | A * | 3/1901 | Davis | 312/114 |
| 1,007,052 | A * | 10/1911 | Batts | 312/131 |
| 2,621,097 | A * | 12/1952 | Steinberg | 312/139.2 |
| 2,786,728 | A * | 3/1957 | Malkin | 312/129 |
| 3,713,719 | A * | 1/1973 | Detterbeck | 312/352 |
| 4,335,292 | A * | 6/1982 | Tanaka et al. | 219/754 |
| 4,572,598 | A * | 2/1986 | Moore, Jr. | 312/284 |
| 4,836,622 | A * | 6/1989 | Ferguson | 312/114 |
| 6,111,224 | A * | 8/2000 | Witt | 219/385 |
| 6,782,802 | B2 * | 8/2004 | Hunot et al. | 99/341 |
| 7,161,125 | B2 * | 1/2007 | Yoshidome et al. | 219/756 |

FOREIGN PATENT DOCUMENTS

JP 2006-158804 6/2006

OTHER PUBLICATIONS

Definition of 'translate' retrieved Aug. 6, 2010 on http://www.google.com.

* cited by examiner

*Primary Examiner*—Darnell M Jayne
*Assistant Examiner*—Timothy M Ayres
(74) *Attorney, Agent, or Firm*—Banner & Witcoff, Ltd.

(57) ABSTRACT

A showcase has a front wall which defines a showroom for a commodity in cooperation with other walls on a customer side, and includes a transparent portion. The showcase also has a support device that supports the transparent portion in such a way that the transparent portion is allowed to be translated to a direction away from the showroom.

6 Claims, 4 Drawing Sheets

SHOWCASE

BACKGROUND OF THE INVENTION

1. Field of the Invention

The present invention relates to a showcase that show goods, such as commodities, and, more particularly, to a showcase suitable for displaying hot commodities while heat-insulating the commodities.

2. Description of the Related Art

There is a showcase which is placed on a counter in a convenience store or the like, for example, to show hot commodities such as grilled chicken, fried chicken, etc.

As this kind of showcase, a showcase disclosed in Japanese Patent Application Laid-Open No. 2006-158804 has its front side formed by a transparent wall of glass or the like which covers a showroom. To clean the inner side of the transparent wall, a rotatable front door covering a normal-temperature area is provided under the transparent wall. This showcase does not allow a customer to directly put his or her hand into the showroom, so that the safety of the customer and sanitary of commodities are considered to be secured.

In the disclosed showcase, while the front door rotates to be open, the transparent wall itself is fixed. To clean the inner side of the transparent wall, therefore, a worker have to move trays in the showroom to avoid interference, then put his or her hand inside through the front door and reach the hand upward. In such an uneasy state, cleaning work is troublesome. In particular, if the showcase is very tall or wide, there may be some areas left insufficiently cleaned. Further, there is a hot portion in the showroom so that the worker should take precautions against burning.

SUMMARY OF THE INVENTION

It is an object of the present invention to provide a showcase which permits safe and easy cleaning of a transparent portion on the customer side while keeping customers' safety and sanitary of commodities.

To achieve the object, according to one aspect of the present invention, there is provided a showcase having a front wall defining a showroom for a commodity in cooperation with other walls on a customer side and including a transparent portion. The showcase also has a support device that supports the transparent portion in such a way that the transparent portion is allowed to be translated to a direction away from the showroom.

To clean the inner side of the transparent portion in the showcase of the present invention, as the transparent portion is translated away from the showroom, a worker can place his or her hand inside the clearance between the transparent portion and the showroom from above, below, the right side and the left side freely.

Therefore, every part of the inner side of the transparent portion can be easily and well cleaned. Because the worker need not place his or her hand into the showroom, the worker is unlikely to contact a hot portion and can carry out the cleaning work safely.

It is preferable that the front wall and other walls should be supported by a main frame, and the support device should be provided between the transparent portion and the main frame.

Because the showcase of a preferred mode has the front wall and other walls supported by a main frame, and the support device provided between the transparent portion and the main frame, the showcase has a high productivity and is inexpensive.

It is preferable that a mechanical room should be defined under the showroom and accommodate at least a part of a heating system for heating the commodity, and the support device should include a guide rail horizontally disposed in the mechanical room, and a slide bar that is integrally secured to the transparent portion and slidably engages with the guide rail.

Because the showcase of a preferred mode has a guide rail disposed in the mechanical room, the space is effectively used to prevent upsizing of the showcase due to the provision of the support device. Since the sliding of the slide bar with respect to the guide rail causes translation of the transparent portion, the transparent portion can be easily translated even with a single hand. Further, the location of the mechanical room under the showroom enhances the degree of freedom in designing the showcase.

BRIEF DESCRIPTION OF THE DRAWINGS

The present invention will become more fully understood from the detailed description given hereinbelow and the accompanying drawings which are given by way of illustration only, and thus, are not limitative of the present invention.

DETAILED DESCRIPTION

Figure 1:
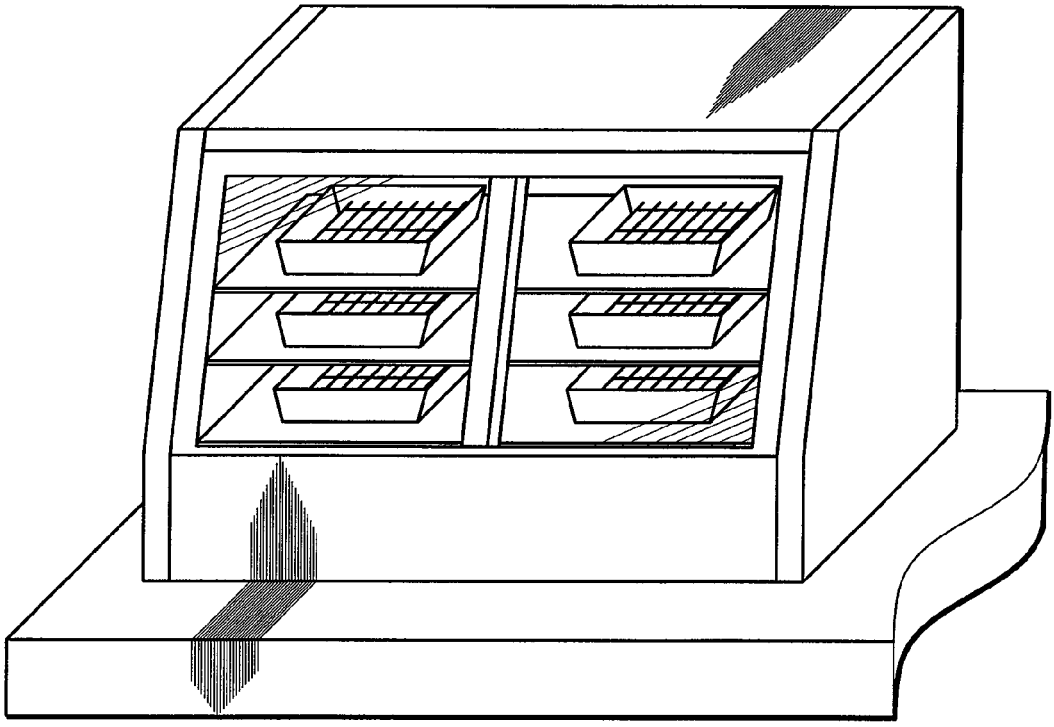
FIG. 1 is a schematic perspective view of a showcase according to one embodiment of the present invention.

FIG. 1 shows a showcase according to one embodiment of the present invention. The showcase is used in a store, such as a convenience store or a superstore, and is placed on a counter in the store. Commodities such as grilled chicken or fried chicken, are displayed inside the showcase.

Figure 2:
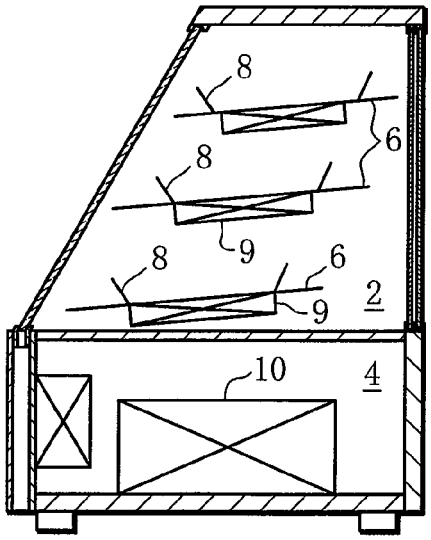
FIG. 2 is a cross-sectional view schematically showing the internal structure of the showcase in FIG. 1.

FIG. 2 schematically shows the internal structure of the showcase in which a showroom 2 and a mechanical room 4 are defined. The showroom 2 is located above the mechanical room 4, with shelves 6 of, for example, two rows by three columns mounted in the showroom 2. Bats 8 are disposed on the respective shelves 6 and the commodities are to be placed on the bats 8.

Heaters 9 of an electric resistance type, for example, are attached to the bottoms of the respective shelves 6. Each heater 9 is electrically connected to a power source box 10. The power source box 10 is disposed in the center of the mechanical room 4, so that when power is supplied to the heaters 9 from the power source box 10, the shelves 6 and the bats 8 are heated to thereby heat commodities. That is, the heaters 9 and the power source box 10 constitute a heating system for heating commodities.

The casing structure of the showcase will be described below.

Figure 3:
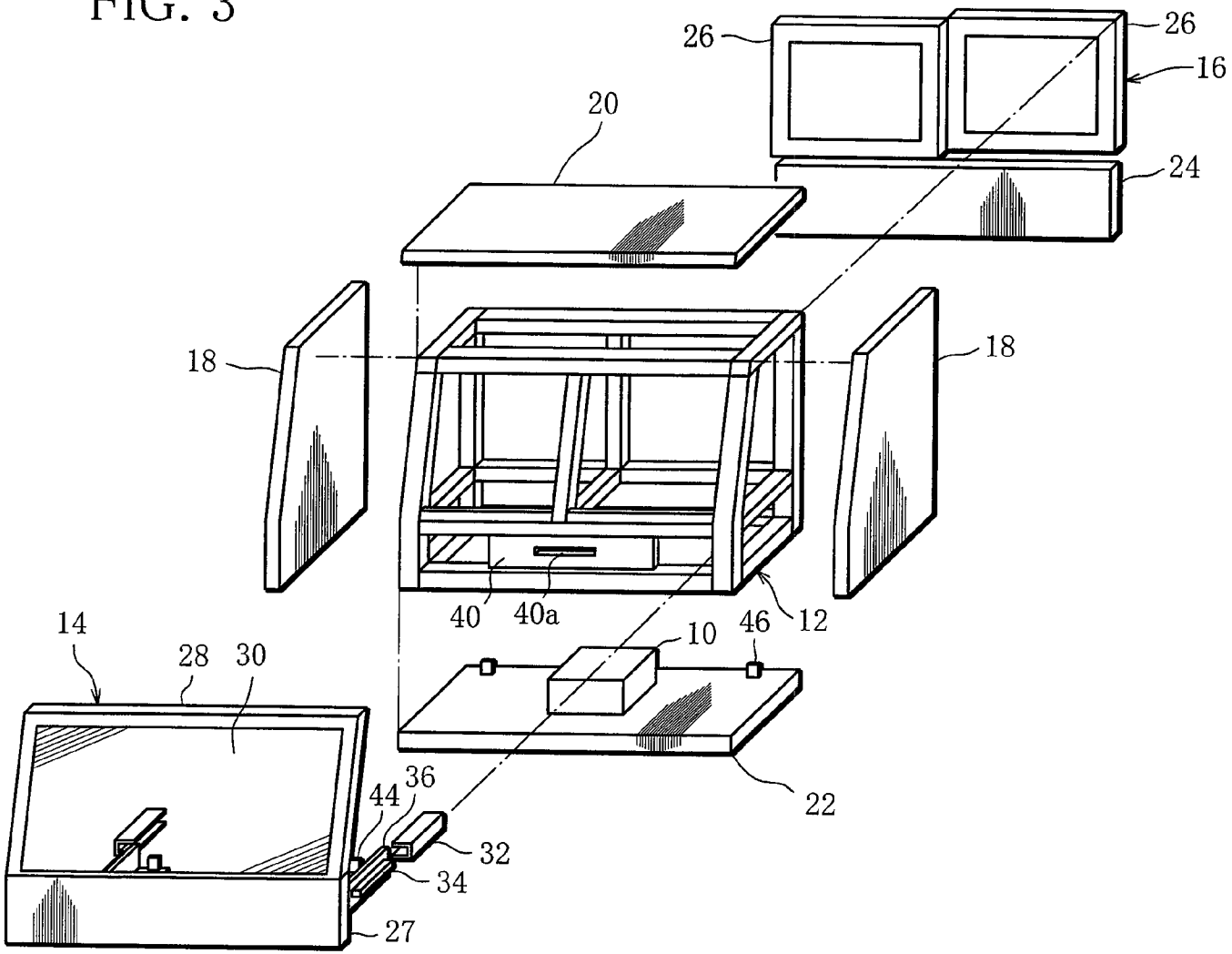
FIG. 3 is a schematic exploded perspective view of the showcase in FIG. 1.

FIG. 3 is a schematic exploded perspective view of the showcase which has a main frame 12. The main frame 12 includes a plurality of columns extending in the height direction, and beams connecting the columns. The main frame 12 is not shown in FIG. 2.

The main frame 12 supports a front wall 14, located on the customer side, a rear wall 16, located on the clerk side, right and left side walls 18, a top wall 20 and a bottom wall 22. The walls 14, 16, 18, 20, 22 partitions a single space in cooperation with one another. The space is defined into the upper showroom 2 and the lower mechanical room 4 by a partition (see FIG. 2).

The top wall 20 and the bottom wall 22 are made of, for example, stainless steel, and are fixed to the main frame 12 by screws, for example. The power source box 10 is disposed nearly in the center portion of the bottom wall 22. The side walls 18 are, for example, glass plates, and are fixed to the main frame 12 by screws, for example.

The rear wall 16 includes a band-like rear plate 24 of stainless steel and two glass doors 26. The rear plate 24 is fixed to the lower side of the main frame 12 by, for example, screws, thus partitioning the mechanical room 4. The glass doors 26 are slidably disposed in an opening portion between the top wall 20 and the rear plate 24, thus partitioning the showroom 2.

A lower portion of the front wall 14 placed on the customer side is constituted by a flat box-shaped wall body 27 of stainless steel, which partitions the mechanical room 4. A rectangular sash 28 is obliquely secured to the upper end of the wall body 27, with a glass plate 30 (transparent portion) being fitted into the sash 28. The sash 28 and the glass plate 30 (which together may also be called "glass window") constitute an upper portion of the front wall 14 and define the showroom 2.

The front wall 14 is not directly fixed to the main frame 12, and a support device is provided between the front wall 14 and the main frame 12. The front wall 14 is supported by the main frame 12 through the support device in such a way that the front wall 14 can move away from the main frame 12. In other words, the front wall 14 is supported and allowed to be translated in a direction away from the showroom 2 by the support device.

Specifically, two guide rails 32 are disposed in the mechanical room 4, and are fixed to the main frame 12. That is, the guide rails 32 are placed apart from each other in the widthwise direction of the showcase with the power source box 10 in between, and extend horizontally in the forward and backward direction of the showcase.

A slide bar 34 having the shape of, for example, a hollow square pipe is slidably engaged with each guide rail 32. Each slide bar 34 also extends in the forward and backward direction. The slide bar 34 is fixed along a bracket 36 which has an L-shaped cross section and whose tip is fixed to the back of the wall body 27. That is, the glass window is fixed to the slide bars 34 via the wall body 27 and the brackets 36. The glass window is supported by the main frame 12 via the guide rails 32 and the slide bars 34, and is allowed to be translated in a direction away from the main frame 12 or forward and backward direction.

Figure 4:
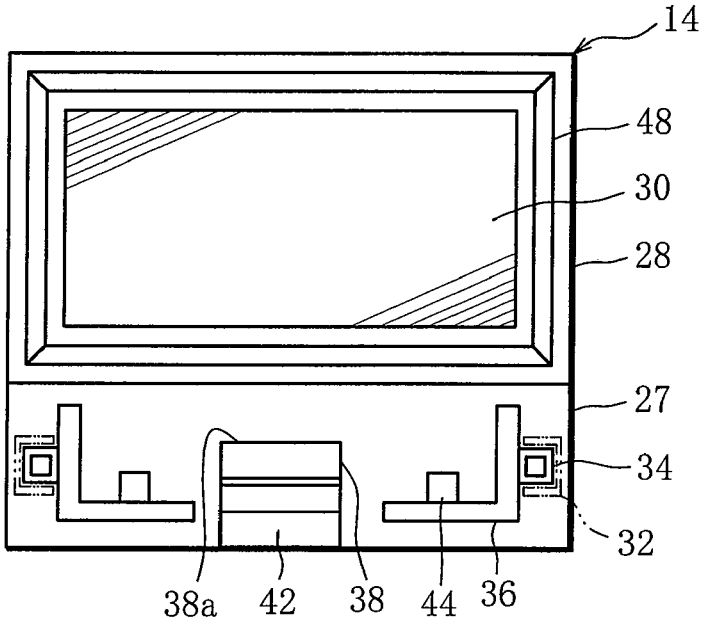
FIG. 4 is a diagram schematically showing the rear side of a front wall adapted to the showcase in FIG. 1.
Figure 5:
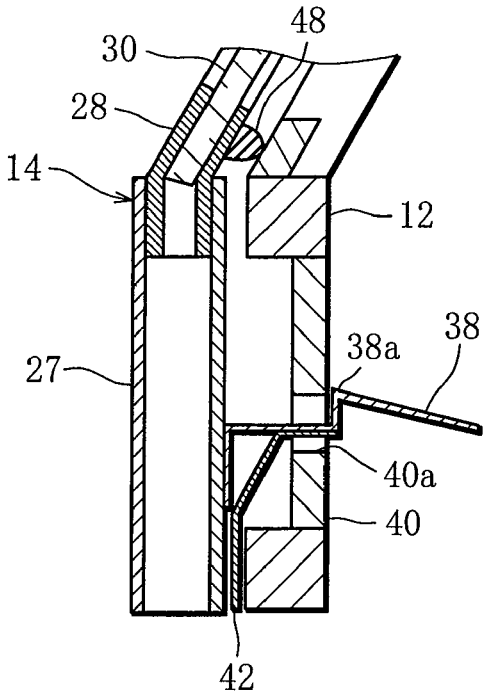
FIG. 5 is a diagram schematically showing the vicinity of an engagement unit for the front wall in FIG. 4.

To hold the front wall 14 closely attached to the main frame 12 (close position), as shown in FIGS. 4 and 5, an elastically deformable first engagement member 38 is attached to the center portion of the back of the wall body 27. The first engagement member 38 is formed by bending a band-like plate member, and protrudes rearward. A projection 38*a* convexly bent upward is formed on the first engagement member 38, locating at a projecting end side thereof.

An engagement plate 40 is fixed to one of the beams of the main frame 12, facing the first engagement member 38. The engagement plate 40 has a hole 40*a* in which the projecting end of the first engagement member 38 can be received. With the front wall 14 positioned closest to the main frame 12 or at the close position, the projection 38*a* of the first engagement member 38 engages with the edge of the hole 40*a*. A lever 42 for disengaging the engaged state is attached to the first engagement member 38, so that when the lever 42 is pulled, the first engagement member 38 is elastically deformed, thus allowing the projection 38*a* to be pulled out of the hole 40*a*.

As a second engagement member, a magnetic body 44 of iron or the like is attached to the inner end of the bracket 36, and a magnet 46 attractable to the magnetic body 44 is fixed to the bottom wall 22.

To show the state of engagement with the slide bar 34, the guide rail 32 is indicated by a two-dot chain line in FIG. 4.

A rubber packing 48 is fixed to the back of the sash 28 of the glass window in such a way as to surround the glass plate 30. As the packing 48 abuts on the main frame 12, the airtightness of the showroom 2 is secured.

The following will explain how to use the showcase.

To show hot commodities such as grilled chicken or fried chicken, a clerk slides one of the glass doors 26 constituting the rear wall 16 right or left to open the showcase, and places the bats 8 having commodities mounted thereon on the shelves 6 or places commodities in the bats 8 already placed on the shelves 6. Alternatively, commodities may be placed directly on the shelves 6. The commodities displayed on the shelves 6 are heated by the heaters 9 to be kept hot as the power is supplied to the heaters 9 from the power source box 10.

A customer can view the displayed commodities through the glass window of the front wall 14, and can indicate a desired commodity to the clerk and can ask the clerk to take it out, and receive it.

Depending on a commodity, oil or the like adheres on the inner side of the glass window. To clean the inner side of the transparent portion, the worker stands directly in front or obliquely in front of the showcase and pulls the lever 42 with his or her hand from below the front wall 14. Accordingly, the first engagement member 38 elastically deforms and comes out of the hole 40*a* of the engagement plate 40, and the magnetic body 44 or the second engagement member is separated from the magnet 46, disengaging the engagement by the first engagement member 38 and the second engagement member and causing the front wall 14 to move away from the main frame 12 or the showroom 2. That is, the lever 42 is a release lever to release the restriction of the movement of the glass window.

Figure 6:
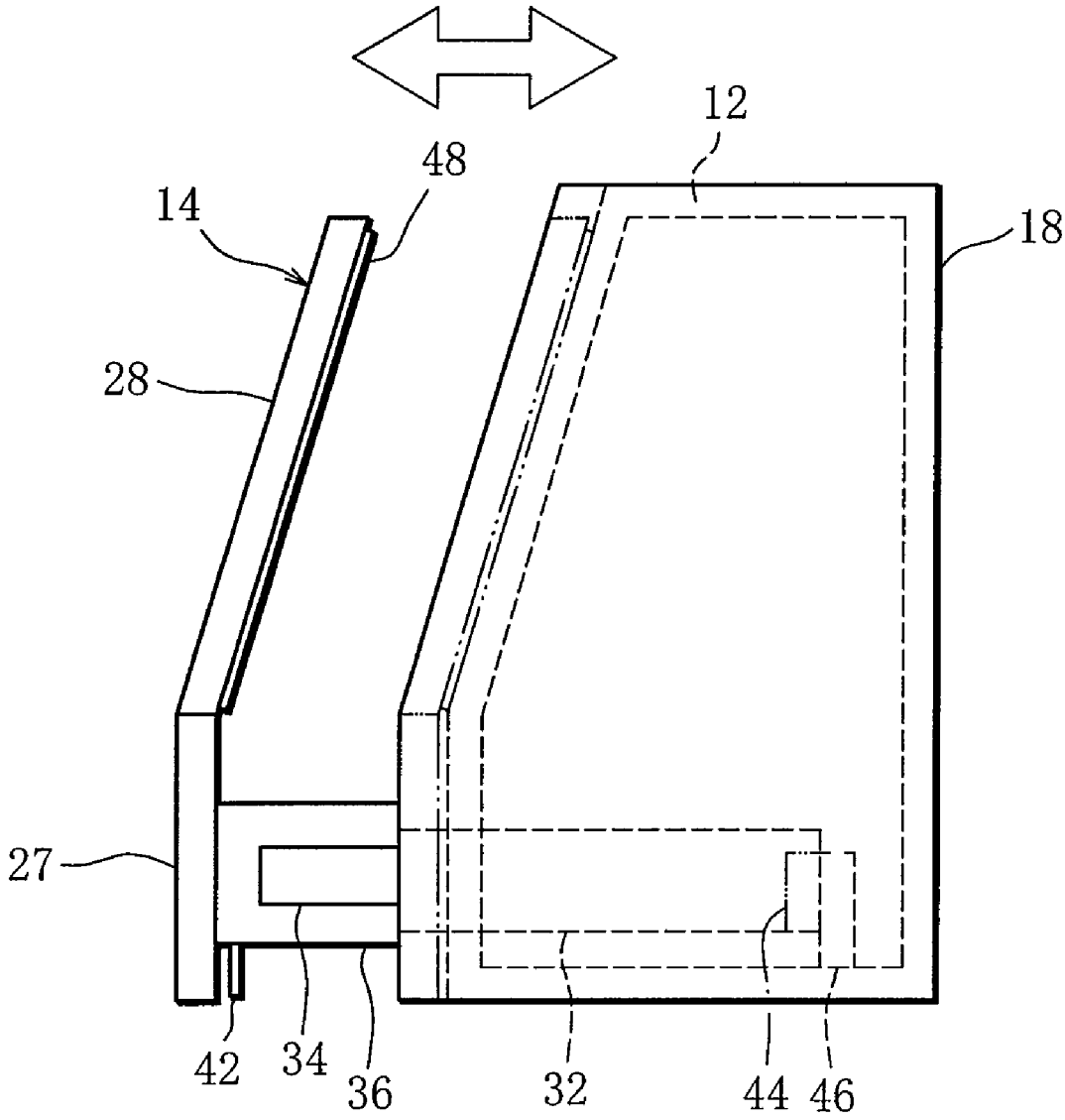
FIG. 6 is a side view showing the front wall pulled out from the showcase in FIG. 1.

As shown in FIG. 6, after an adequate clearance is secured between the front wall 14 and the main frame 12, a worker should put a hand in the clearance to clean the inner side of the glass window.

In cleaning the inner side of the glass window or the transparent portion in the showcase of the embodiment, as mentioned above, as the glass window is translated forward away from the main frame 12, the worker can easily put his or her hand in the clearance between the glass window and the showroom 2 from above, below, right side or left side.

Therefore, every part of the inner side of the glass window of the showcase is easily cleaned. Because the worker need not put his or her hand in the showroom 2, the worker is unlikely to contact a hot portion and can perform the cleaning work safely.

In addition, as the slide bars 34 are slid along the guide rails 32, the glass window makes a translational movement, so that the glass window can be easily translated even with one hand.

The present invention is not limited to the above-described embodiment, and can be modified in various forms.

While the front wall 14, the rear wall 16, the side walls 18, the top wall 20 and the bottom wall 22 are supported by the main frame 12 in the showcase of the embodiment, the showcase may take a frameless structure. That is, the rear wall 16, the side walls 18, the top wall 20 and the bottom wall 22 may be directly connected to one another. In this case, the guide rails 32 may be fixed to the side walls 18 or the bottom wall 22.

A box formed by sheet metal processing may be used only for the mechanical room 4, and a main frame for the showroom 2 may be assembled on the box. The use of a frame structure at least for the showroom 2 can increase the productivity of the showcase and suppress the cost.

Although the showcase of the embodiment has the slide bars 34 integrally fixed to the wall body 27 via the brackets 36, the slide bars 34 have only to be integrally fixed to the glass plate 30.

Although the guide rails 32 and the slide bars 34 are disposed in the mechanical room 4 below the showroom 2 and the slide bars 34 are coupled to the wall body 27 of the front wall 14, the guide rails 32 and the slide bars 34 may be disposed above the showroom 2 and the slide bars 34 may be coupled to the upper side of the front wall 14.

Note that arrangement of the guide rails 32 and the slide bars 34 in the mechanical room 4 is preferable because the arrangement does not enlarge the showcase. Further, because the mechanical room 4 is located under the showroom 2, the degree of freedom in designing the showcase is high.

The numbers of the guide rails 32 and the slide bars 34 are not particularly limited. When the front wall 14 is small, the numbers of the guide rails 32 and the slide bars 34 can be one each. Normally, it is preferable that the numbers of the guide rails 32 and the slide bars 34 be two or more.

If the numbers of the guide rails 32 and the slide bars 34 are two, it is preferable that the slide bars 34 are apart from each other in the width direction of the transparent portion. In other words, it is preferable that the slide bars 34 are located at both ends of the transparent portion, respectively. This is because the worker can easily clean the whole of the transparent portion without interference with the slide bars 34 when the worker stands in front of the showcase and puts his or her hand in the clearance from below through the slide bars 34.

The direction of the translational movement of the front wall 14 or the lengthwise direction of the guide rails 32 and the slide bars 34 may be inclined slightly with respect to the horizontal direction.

The engagement unit for holding the front wall 14 abutting on the main frame 12 is not particularly limited. Although, as the second engagement member, the magnetic body 44 is attached to the bracket 36 and the magnet 46 is attached to the bottom wall 22, the second engagement member, for example, the magnetic body 44 and the magnet 46 may be attached to the bottom wall 22 and the bracket 36, respectively. The magnetic body 44 may be formed integral with the bracket 36, or magnets which are attracted to each other may be disposed on the bracket 36 and the bottom wall 22, respectively.

Although with the front wall 14 at the close position, the glass window and the main frame 12 are sealed by the rubber packing 48 in the showcase, a magnetic packing if used can restrict movement of the front wall 14 as the packing is attracted to the main frame 12. It is however preferred that to prevent the front wall 14 from being opened unintentionally, the movement of the front wall 14 should be restricted by two or more engagement members.

Although commodities are heated by the electric resistant heaters 9 in the embodiment, commodity heating means is not particularly limited and a lamp type heater may be used.

Finally, while the showcase of the present invention is suitable for showing commodities while heating them, the showcase can of course be adapted to a refrigerating showcase or a freezing showcase.

With the invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A showcase comprising:

a front wall including a transparent portion defining a showroom for a commodity in cooperation with other walls on a customer side, a main frame supporting the front wall and other walls, a mechanical room under the showroom accommodating at least a part of a heating system for heating the commodity, a support device between the front wall and the main frame, including slide bars spaced apart from each other in a width direction of the front wall and integrally secured to the front wall and guide rails horizontally disposed in the mechanical room, with each slide bar slidably engaged with a guide rail, supporting the front wall and allowing the front wall to be translated to a direction away from the showroom, and an engagement unit for restricting movement of the front wall, including an elastically deformable engagement member having a projection and an engagement plate having a hole for receiving the projection, wherein the projection of the engagement member engages with the edge of the hole when the front wall is positioned closest to the main frame in the closed position.

2. The showcase according to claim 1, wherein the engagement unit further includes a release lever for deforming the engagement member to release the projection from the hole.

3. The showcase according to claim 2, wherein the engagement unit further includes a magnet.

4. The showcase according to claim 2, wherein the engagement unit further includes a magnetic packing for securing airtightness of the showroom.

5. The showcase according to claim 1, wherein the engagement unit further includes a magnet.

6. The showcase according to claim 1, wherein the engagement unit further includes a magnetic packing for securing airtightness of the showroom.

* * * * *